US005409765A

United States Patent [19]

Boettcher et al.

[11] Patent Number: 5,409,765

[45] Date of Patent: Apr. 25, 1995

[54] NONWOVEN WEBS MADE FROM IONOMERS

[75] Inventors: Jeffrey J. Boettcher, Appleton, Wis.; John J. Allan, Simpsonville, S.C.; Leon Katz, Stamford, Conn.

[73] Assignee: Fiberweb North America, Inc., Simpsonville, S.C.

[21] Appl. No.: 101,925

[22] Filed: Aug. 4, 1993

[51] Int. Cl.[6] ..... D04H 1/04; D04H 1/70

[52] U.S. Cl. ..... 428/224; 156/62.4; 428/288; 428/296

[58] Field of Search ..... 156/62.4; 428/288, 224, 428/296, 903

[56] References Cited

U.S. PATENT DOCUMENTS

| | | | |
|---|---|---|---|
| 3,801,551 | 4/1974 | Bohme . | |
| 3,966,679 | 6/1976 | Gross . | |
| 3,972,759 | 8/1976 | Buntin . | |
| 3,978,185 | 8/1976 | Buntin . | |
| 4,192,827 | 3/1980 | Mueller et al. . | |
| 4,449,977 | 5/1984 | Korpman . | |
| 4,529,739 | 7/1985 | Scott et al. . | |
| 4,622,259 | 11/1986 | McAmish . | |
| 4,707,398 | 11/1987 | Boggs . | |
| 4,724,184 | 2/1988 | Killian et al. . | |
| 4,731,067 | 3/1988 | Le-Khac . | |
| 4,741,949 | 5/1988 | Morman et al. . | |
| 4,767,825 | 8/1988 | Pazos et al. . | |
| 4,803,117 | 2/1989 | Daponte | 428/228 |
| 4,806,598 | 2/1989 | Morman . | |
| 4,820,560 | 4/1989 | Buchwald et al. . | |
| 4,820,572 | 4/1989 | Killian et al. . | |
| 4,820,577 | 4/1989 | Morman et al. . | |
| 4,828,911 | 5/1989 | Morman . | |
| 4,919,997 | 4/1990 | Twilley et al. . | |
| 4,957,795 | 9/1990 | Riedel . | |
| 4,985,023 | 1/1991 | Blank et al. . | |
| 5,001,011 | 3/1991 | Plueddemann . | |
| 5,002,831 | 3/1991 | Plueddemann . | |
| 5,120,598 | 6/1992 | Robeson et al. | 428/288 |

FOREIGN PATENT DOCUMENTS

| | | |
|---|---|---|
| 0351318 | 1/1990 | European Pat. Off. . |

*Primary Examiner*—James C. Cannon

*Attorney, Agent, or Firm*—Bell, Seltzer, Park & Gibson

[57] ABSTRACT

A process is disclosed for extruding fibers from ionomer resins that are not blended with polyolefins, monomers, solvents, or other conventional compounds typically used in connection with processing fibers that contain ionomers. The preferred ionomers are 90% neutralized metal salts of copolymers of from at least about 60 to 90% ethylene and from at least about 10 to 40% acrylic acid. Multivalent metal cations can be used to introduce cross linking for control of the solubility and swellability of the fibers. The fibers and webs produced therefrom can be produced by meltblowing and can be used to provide a less expensive alternative to superabsorbent powders.

33 Claims, No Drawings

NONWOVEN WEBS MADE FROM IONOMERS

FIELD OF THE INVENTION

The invention relates to synthetic fibers and webs produced from polymer resins. In particular, the invention relates to fibers and webs containing ionomeric polymers or "ionomers."

BACKGROUND OF THE INVENTION

Salts of various compounds containing acid moieties, including ionomeric polymers, are known to be hydrophilic and have been used in a variety of applications where increased fluid absorbency is desirable, typically as super absorbent powders. Superabsorbent powders have been used to increase the absorbency of diapers, wipes, and cable wrapping strips for high voltage electrical cables, to name but a few uses for these compounds. For example, Buchwald et al. U.S. Pat. No. 4,820,560 discloses that a cross linked sodium salt of a polyacrylic acid serves as a super absorbent swellable powder for use in cable wrapping strips for high voltage electrical lines. The cable wrap is a nonwoven fabric containing the superabsorbent powder and swells upon exposure to moisture to seal the cable core from water and prevent the propagation of water lengthwise of the cable. Gross U.S. Pat. No. 3,966,679 discloses that cross linked salts of polymers containing carboxylic acid groups are useful as water swellable absorbent particles for incorporation in surgical sponges, diapers, tampons, meat trays, bath mats, and the like products.

Superabsorbent powders can be somewhat costly to prepare and their incorporation into fabrics and other articles for providing increased absorbency normally adds manufacturing and fabricating steps, increasing the cost of providing the fabric or article. Problems have also been encountered in keeping the powder fixed in the fabric or other article until use.

Another method for using hydrophilic compounds in fabrics and other articles that avoids some of the complications of powders is to form fibers and fibrous structures from fiber forming compositions that contain one or more hydrophilic compounds. For example, salts of acid containing copolymers, including ionomers, have been incorporated into the polymer resins from which fibers and various fibrous structures have been made, thus avoiding some of the problems associated with using superabsorbent powders. Bohme U.S. Pat. No. 3,801,551 discloses that acid polymers including salts of acid polymers may be converted to fibrillar masses by digesting structured solid granules of the compounds in aqueous alkaline media and applying shear forces by intensive stirring to convert the granules to fibrillar masses. The fibrillar masses are disclosed to be useful for mixing with other fibrous materials to make felted articles, paper-like products, filters, and the like, and for shaping into cups and other articles.

Le-Khac U.S. Pat. No. 4,731.,067 discloses dry spinning of fibers from copolymers including some ionomers to produce water-.absorbing compositions. The copolymers described by Le-Khac are blended with from about one to ten percent by weight (blended weight) of at least one monomer having a molecular weight less than 1000 and containing at least two hydroxyl groups. The monomer is said to serve as a cross linking agent for the copolymer, which results in the formation of covalent bonds upon curing at elevated temperatures of from, for example, 140° C. or higher to 200° C. or higher, depending upon the copolymer.

Dry spinning is characterized by extruding a solution of a fiber.-forming substance dissolved in a suitable solvent in a continuous stream and into a heated chamber to remove the solvent, leaving the solid filament, as is commonly used in the manufacture of acetate. Le-Khac U.S. Pat. No. 4,731,067 exemplifies a dry spinning method wherein fibers are spun from an aqueous solution of polymer and the water is then evaporated. Dry spinning sometimes is referred to in the technical literature as solvent spinning.

Dry spinning is distinguished from other methods of producing synthetic fibers, such as melt spinning. In melt spinning a molten fiber is extruded from a molten fiber forming substance through a die or spinneret in the absence of a solvent and at a constant rate under high pressure. The liquid polymer streams merge downward from the face of this spinneret, into air or other gas or into a suitable liquid. The polymer streams solidify and typically are used to form either meltblown or spunbonded webs, as described below, or drawn or attenuated mechanically after solidification using Godet rolls and are brought together to form threads and wound up on bobbins. In comparison to melt spinning, dry spinning is a more complicated, time consuming, and costly procedure and requires more careful treatment of the fibers produced therefrom.

Meltblowing, in particular, is an economical method for producing nonwoven products. In melt blowing, the extruded molten fibers are attenuated and then broken with a hot, high velocity air stream or steam to produce short fiber lengths. The short fibers are collected on a moving screen where they bond during cooling. Meltblowing is discussed in patent literature, e.g. Buntin, et al. U.S. Pat. No. 3,978.185; Buntin U.S. Pat. No. 3,972,759; and McAmish et al. U.S. Pat. No. 4,622,259. These patent disclosures are hereby incorporated by reference.

To form a spunbonded web, a molten polymer is extruded through a spinneret to form a multiplicity of continuous filaments, and the filaments of molten polymer are solidified and then drawn or attenuated, typically by a high velocity fluid, and then randomly deposited on a collection surface, such as a moving belt, to form a web. The filaments are then bonded to give the web coherency and strength.

European Patent Application Publication No. 0 351 318 describes meltblowing polymeric dispersions of incompatible thermoplastic resins, some of which include ionomers. The various polymeric dispersions include blends of polypropylene with ionomers that are sodium and calcium salts of copolymers of acrylic acid and ethylene. One thermoplastic resin forms a continuous phase, and one forms microfibrils dispersed as a separate phase. The multi-component fiber can be used to prepare nonwoven webs, or the continuous phase can be dissolved to yield microfibrils that can be made into various products. The webs and microfibrils may be used as wipes, napkins and personal care items; absorbents for drugs, urine, and similar fluids; for release of bactericides, drugs, fungicides, and insecticides; as filters, ionic exchange resins, and battery separators.

Although blends of ionomers with polyolefins, monomers, or other cross linking agents or incompatible polymers have been used to produce fibers and nonwoven webs, ionomers in the unblended state have not been used to produce fibers and nonwoven webs.

Blending the ionomers with polyolefins, monomers, or other cross linking agents or incompatible polymers introduces complexity into the fiber spinning process and limits the properties available in fibers and webs produced from the blends.

SUMMARY OF THE INVENTION

The invention is directed to nonwoven webs of ionomeric fibers produced by extrusion of a molten polymer resin consisting essentially of one or more ionomers or one or more ionomers mixed with a compatible copolymer or terpolymer. Thus, the ionomers are not blended with polyolefins, monomers, or other cross linking agents or incompatible polymers. "Compatible" means that upon extruding fibers from one or more ionomers mixed with a copolymer or terpolymer, the cations can be evenly distributed over the fibers so that the fibers show substantially no heterogeneity.

The invention also includes a process for forming fibers from an unblended ionomer resin and products made from such fibers, such as hydrophilic wipes, absorptive liners, filters, and swellable wraps for high voltage electrical cables. Swelling and solubility of the fibers can be controlled by introducing cross linking in the ionomer through the use of various multivalent cations including $Ca^{+2}$, $Mg^{+2}$, $Ba^{+2}$, $Al^{+3}$, $Ti^{+4}$, and the like.

The invention can be used to prepare highly absorbent nonwoven webs by relatively inexpensive processes and using inexpensive starting materials. The commercially available ionomer resins typically are inexpensive and can be melt blown or extruded to produce spunbonded webs. The webs can be extremely hygroscopic and water-absorptive.

DETAILED DESCRIPTION OF THE INVENTION

The invention is directed to the production of fibers and nonwoven webs by extrusion of fibers from a molten ionomer resin not blended with polypropylene, polyethylene, or other typical polyolefins. The ionomers are salts of a copolymer or terpolymer that include a plurality of chemical groups derived from an ethylenically unsaturated sulfonic acid or carboxylic acid or anhydride precursor of an ethylenically unsaturated carboxylic acid. At least a portion of the carboxylic acid groups or acid anhydride groups are neutralized to form salts of univalent or multivalent cations or with ammonia or organic bases such as amines. Examples of some representative acid containing polymers that may be converted to ionomers are found in Bohme U.S. Pat. No. 3,801,551, which patent is incorporated by reference.

Typical acid polymers are addition polymers of ethylenically unsaturated monomers where the starting monomers include non-acid monomers and a plurality of monomers having an acid group or acid anhydride group capable of neutralization by aqueous base to form a salt. For example, suitable polymers are the copolymerization or terpolymerization products of one or more polymerizable ethylenically unsaturated sulfonic acids or carboxylic acids and one or more non-acid polymerizable monomers. The acids include acrylic acid, methacrylic acid, maleic acid and the anhydride, itaconic acid, fumaric acid, citraconic acid and the anhydride, methyl hydrogen maleate, and the like. The non-acid monomers include ethylene, propylene, butene-1, 1,3-butadiene, and other aliphatic olefins; styrene, α-methylstyrene, vinyltoluene, chlorostyrene, and other aromatic olefins; ethyl acrylate, methyl methacrylate, vinyl acetate and other unsaturated esters, vinyl and vinylidene chloride; vinyl ethers; acrylamide; acrylonitrile; and the like.

In general, the acid comonomer moiety is at least about 1% by weight of the copolymer. Preferably, the acid comonomer moiety is at least about 11% by weight of the copolymer when the remaining monomer moiety is non-polar, such as a hydrocarbon. The acid comonomer moiety preferably is at least about 8% by weight of the copolymer when the remaining monomer moiety is a polar monomer such as an ester comonomer, the acid comonomer moiety of the copolymer usually being not more than about 40% by weight of the copolymer.

Some of the ionomers may be derived from copolymers and terpolymers as set forth in Bohme U.S. Pat. No. 3,801,551 as follows. Suitable copolymers include:

(1) Copolymers of at least about 60% by weight ethylene and from at least about 11% to about 30% by weight of one or more ethylenically unsaturated acids such as acrylic acid, methacrylic acid, methyl hydrogen maleate, and others, as recited above.

(2) Copolymers of at least about 60% by weight of ethylene, from about 8 to about 30% by weight of one or more ethylenically unsaturated acids, and from about 5 to about 20% by weight of one or more other monomers such as ethyl acrylate, vinyl acetate, and others, as recited above.

(3) Copolymers of styrene (or other vinyl-aromatic compounds) and from about 11 to about 30% by weight of one or more ethylenically unsaturated acids such as acrylic acid, maleic anhydride, and others, as recited above.

Other carboxylic acid containing polymers are made from preformed and non-acid polymers by subsequent chemical reaction carried out thereon. For example, the carboxylic acid group may be supplied by grafting a monomer, such as acrylic acid or maleic anhydride, onto a polymer substrate; carboxylic anhydride, ester, amide, acyl halide, and nitrile groups can be hydrolyzed to carboxylic acid groups.

Specific examples and illustrations of representative organic acid copolymers that may be suitable for conversion to ionomers for use in the practice of the invention claimed herein, given for purposes of illuminating the description and not to limit the scope of the invention, are: ethylene/acrylic acid copolymers; ethylene/methacrylic acid copolymers; ethylene/itaconic acid copolymers; ethylene/methyl hydrogen maleate copolymers; ethylene/maleic acid copolymers; ethylene/acrylic acid/methyl methacrylate (ternary) copolymers; ethylene/acrylic acid/ethyl acrylate copolymers; ethylene/methacrylic acid/ethyl acrylate copolymers; ethylene/itaconic acid/methyl methacrylate copolymers; ethylene/methyl hydrogen maleate/ethyl acrylate copolymers; ethylene/acrylic acid/vinyl acetate copolymers; ethylene/methacrylic acid/vinyl acetate copolymers; ethylene/acrylic acid/vinyl alcohol copolymers; ethylene/propylene/acrylic acid copolymers, ethylene/acrylamide/acrylic acid copolymers; ethylene/styrene/acrylic acid copolymers; ethylene/methacrylic acid/acrylonitrile copolymers; ethylene/fumaric acid/vinyl methyl ether copolymers; ethylene/vinyl chloride/acrylic acid copolymers; ethylene/vinylidene chloride/acrylic acid copolymers; polyethylene/acrylic acid graft copolymers; polyethylene/methacrylic acid graft copolymers; polymerized ethylene/propylene/acrylic acid graft copolymers; styrene/acrylic acid copolymers; styrene/methacrylic acid copolymers; styrene/itaconic acid copolymers; styrene/methyl methacrylate/acrylic acid copolymers; styrene/maleic anhydride copolymers; styrene/citraconic anhydride copolymers; para-chlorostyrene/acrylic acid copolymers; para-t-butylstyrene/acrylate acid copolymers; and methyl methacrylate/isobutyl acrylate/acrylic acid copolymers.

The above carboxylic acid-containing polymers may be converted to ionomer resins by neutralization of at least a portion of the carboxylic acid groups with a salt-forming cation such as metal ions having valences of 1 or greater or with ammonia or organic bases such as amines. Generally, at least about 10% to 100% of the acid groups are neutralized for use in the practice of the invention.

Ionomers contemplated for use in the practice of the invention include those copolymers or terpolymers having cations of sodium, potassium, lithium, calcium, magnesium, barium, aluminum, titanium, and cations derived from ammonia or amines, and blends thereof, that include at least one chemical group derived from an ethylenically unsaturated sulfonic acid or carboxylic acid or anhydride precursor of an ethylenically unsaturated carboxylic acid. Ionomers commercially available for use in the practice of the invention include sodium, potassium, calcium, magnesium, and aluminum salts of ethylene and acrylic acid copolymers sold by Allied Signal Inc., Morristown, N.J., under the trade name AClyn. Specific ethylene and acrylic acid copolymers are 77% ethylene and 23% acrylic acid and 67% ethylene and 33% acrylic acid.

Olefin-maleic anhydride copolymers and terpolymers are available from S.C. Johnson & Son, Inc., Racine, Wis., and can be converted at least in part to salts by treatment of the resin with a base.

Mixtures of ionomers behave similarly to single ionomers. For example, fibers from a meltblown blend of ionomers can show no heterogeneity when examined by electron micrographs. A blend of sodium and magnesium ionomers of 90% neutralized salts of copolymers of 23% acrylic acid and 77% ethylene produce fibers in which the metal cations are intimately distributed throughout. While not wishing to be bound by theory, it is believed that either the ionomer resins blended intimately, or the cations interchanged between the two ionomers.

Also, if a mixture of an ionomer and its copolymer or terpolymer precursor, or other compatible copolymer or terpolymer, is melt extruded in accordance with the invention and under conditions of sufficient heat and mixing to promote redistribution of the cationic moieties, then a homogeneous composition is obtained.

The fibers and webs of the invention can be produced by extrusion of fibers from a molten ionomer resin by melt spinning methods that are documented in the art, including by meltblowing or spinning of continuous filaments, both of which techniques are documented in the art. Specifically, the fibers and webs of the invention can be produced by meltblowing ionomer resins using the controlled polymer degradation techniques set forth in Buntin U.S. Pat. No. 3,972,759, which is incorporated herein by reference. Webs can also be formed by spunbonding continuous filaments or by weaving continuous filaments that have been formed into threads and wound up on bobbins. However, with any of these techniques, special precautions may need to be taken with hygroscopic fibers and webs substantially to preclude absorption of water.

In the method of the Buntin patent, the thermoplastic resin is subjected to a controlled thermal degradation, optionally promoted by a free radical source compound. For higher molecular weight ionomers, it may be necessary to use a free radical source to obtain the desired thermal degradation of the polymer prior to meltblowing, but lower molecular weight ionomers typically will be used.

The fibers and webs produced therefrom are useful as absorbents for water, urine, blood and other bodily exudates and bases generally, as swellable cable wraps for moisture barriers for high voltage cables, as ion exchange resins, as adhesives, and the webs can be used for electrically conductive webs, to name but few uses. The absorbing capacity or solubility depends upon the content of carboxyl groups, the proportion of carboxyl groups converted to salts, and the type of salt, and these factors may be adjusted for particular requirements. For example, the use of various multivalent cations including $Ca^{+2}$, $Mg^{+2}$, $Ba^{+2}$, $Al^{+3}$, $Ti^{+4}$, and the like can be used to introduce cross linking in the fiber and to control the amount of cross linking, enabling fibers and webs produced therefrom to be customized with respect to water solubility and the absorption of water, salt solutions, urine, blood, or other bodily exudates, and bases generally.

The size of the fibers formed in accordance with the invention can be controlled to provide maximum surface area for absorption and to provide fibers that may be more easily handled for certain applications. For example, for some meltblown absorptive webs, such as webs used in diaper and personal care products, microfibers of from about 2 to 10 microns in diameter sometimes are preferred for maximum surface area and greatest absorption. For other applications, such as for cable wrap, somewhat larger fibers can be more easily handled and can be more practical. Typically, meltblown fibers are produced that range from microfiber size to about 50 microns or more, although meltblown fibers can be produced that are about 100 to 300 microns in diameter. At the larger sizes it may not be practical to meltblow the webs, and another melt spinning technique may be used and the web formed by weaving or spunbonding.

Fibers of the invention can be used alone or in composites. For example, fibers produced in accordance with the invention can be formed into a web with fibers of other compositions. Binder fibers can be incorporated into a web of the invention to provide support and strengthen the web or for lamination of the web to surfaces such as fabric surfaces. Other fibers with desirable characteristics can be used in a composite web to provide a web having characteristics of the individual fibers of the web.

Webs of the invention, including composites, can be used in laminates to provide structures having characteristics of the individual layers of the laminate. For example, a web of micro fibers made in accordance with the invention can be laminated to a nonporous outer layer and a porous inner layer to form an absorptive liner in a structure such as a diaper or other garment, dressing, or personal care item. Webs of the present invention can be laminated by the techniques documented in the art such as point bonding through the application of heat and pressure or through the use of adhesives.

The following working examples illustrate the invention claimed herein.

EXAMPLE 1

A sodium salt of ethylene acrylic acid (Na-EAA available from Allied-Signal Corp.) containing 77% ethylene and 23% acrylic acid by weight of the copolymer and having been 50% neutralized with NaOH, was meltblown into a continuous web using a method similar to that disclosed in Bohme U.S. Pat. No. 3,972,759. The web, wetted out and dissolved in water.

The web had a basis weight of 161 $g/m^2$ and a web thickness of 44 mils. Density was determined to be 0.144 $g/cm^3$. The web had a Gurley permeability of 27 $cfm/ft^2$.

The above physical characteristics were determined as follows. For determining basis weight, samples were cut using a razor blade and a metal template (50×200 millimeters) and the sample was weighed to the nearest 0.001 gram. The specimens were dried and equilibrated to ambient conditions before weighing. The basis weight is reported, in grams per square meter ($g/m^2$), as the weight of the sample ×100.

The caliper, or thickness of the web, was measured using an Ames gauge (Model 79-011; Ames Inc., Waltham, Mass.) with zero load.

The Gurley permeability of air through the web was determined using a Gurley Permeometer (Model 4301; Teledyne Gurley, Troy, N.Y.) for a two-inch-diameter disc of the web with an air pressure of 0.5 inch of water. Data are reported as the flow rate in cubic feet per minute ($ft^3/min$) through one square foot of material.

EXAMPLE 2

A tumble-blended mixture of 5% of a magnesium salt of H-EAA by weight (Mg-EAA containing 77% ethylene and 23% acrylic acid by weight of the copolymer and being 90% neutralized with magnesium hydroxide) in a sodium ionomer of H-EAA (Na-EAA available from Allied-Signal Corp., containing 77% ethylene and 23% acrylic acid by weight of the copolymer and being 90% neutralized with NaOH) was melt blown into a continuous web using a method similar to that disclosed in Bohme U.S. Pat. No. 3,972,759. The web was readily wettable and swelled considerably on contact with water.

A sample of the web was frozen in a liquid nitrogen bath and fractured along the desired plane using a razor blade. The exposed fracture was sputter coated with gold-palladium (Model: Desk II; Denton Vacuum, Inc.) prior to analysis using a scanning electron microscope (JSM-840A, JEOL Instruments, Inc.). Photographs taken through the SEM of fiber cross-sections showed no discernable phase separation at a magnification of 10,000×.

It will be appreciated that various changes may be made in the details regarding the materials, processes, and products described herein without departing from the invention as defined in the appended claims.

What is claimed is:

1. A nonwoven web comprising fibers formed by extruding a molten polymeric resin that consists essentially of one or more ionomers or one or more ionomers mixed with a compatible copolymer or terpolymer.

2. The web of claim 1 wherein said one or more ionomers are salts of copolymers or terpolymers containing groups derived from ethylenically unsaturated sulfonic acids and carboxylic acids or anhydride precursors thereof and wherein the acid groups of the copolymer or terpolymer comprise at least about 1% by weight of said copolymer.

3. The web of claim 2 wherein the acid groups of the copolymer or terpolymer comprise at least about 8% to 40% by weight of said copolymer or terpolymer.

4. The web of claim 3 wherein said one or more ionomers are salts of copolymers of from at least about 60 to 90% by weight ethylene and from at least about 10 to 40% by weight acrylic acid, and wherein from at least about 10% to 100% of said acid groups are neutralized.

5. The web of claim 4 wherein said one or more ionomers are salts of copolymers selected from among the group comprising copolymers of about 77% ethylene and 23% acrylic acid by weight and copolymers of about 67% ethylene and 33% acrylic acid by weight.

6. The web of claim 1 wherein solubility and swelling of the fibers in the web is controlled by the addition of multivalent metal ions.

7. The web of claim 6 wherein said multivalent metal ions are selected from among the group consisting of $Ca^{+2}$, $Mg^{+2}$, $Ba^{+2}$, $Al^{+3}$, and $Ti^{+4}$.

8. The web of claim 1 wherein said one or more ionomers are selected from among the group consisting of copolymers and terpolymers containing cations of sodium, potassium, lithium, calcium, magnesium, barium, aluminum, and titanium, and cations derived from ammonia or amines, and blends of said ionomers.

9. The nonwowen web of claim 1 wherein said web is a meltblown web.

10. The meltblown web of claim 9 wherein said web comprises microfibers.

11. A hydrophilic wipe comprising the nonwoven web of claim 1.

12. An absorptive liner for a garment, dressing, or personnel care item, the liner comprising the nonwoven web of claim 1.

13. A filter comprising the nonwoven web of claim 1.

14. A wrap for a cable comprising the nonwoven web of claim 1.

15. A laminate structure comprising at least two layers wherein at least one of said layers comprises the nonwoven web of claim 1.

16. A nonwoven web comprising microfibers having a diameter of from about 2 to 10 microns formed by meltblowing a molten polymeric resin that consists essentially of one or more ionomers or one or more ionomers mixed with a compatible copolymer or terpolymer.

17. An absorbent nonwoven web comprising fibers formed by extruding a molten polymeric resin that consists essentially of one or more ionomers or one or more ionomers mixed with a compatible copolymer or terpolymer, and wherein said one or more ionomers are selected from among the group consisting of copolymers and terpolymers containing cations of sodium, potassium, lithium, calcium, magnesium, barium, aluminum, and titanium, and cations derived from ammonia or amines, and blends of said ionomers.

18. A nonwoven web comprising fibers formed by extruding a molten polymeric resin that consists essentially of one or more ionomers or one or more ionomers mixed with a compatible copolymer or terpolymer, and wherein said one or more ionomers includes at least one ionomer that contains about 77% ethylene and about 23% acrylic acid by weight and wherein about 50% of the acid groups have been neutralized with sodium hydroxide.

19. An absorbent nonwoven web comprising fibers formed by extruding a molten polymeric resin that consists essentially of a mixture of at least two ionomers or at least two ionomers mixed with a compatible copolymer or terpolymer, said at least two ionomers each containing about 77% ethylene and about 23% acrylic acid by weight and wherein about 90% of the acid groups have been neutralized, the acid groups of one of said ionomers having been neutralized with magnesium hydroxide, and the acid groups of another of said ionomers having been neutralized with sodium hydroxide.

20. The web of claim 19 wherein said ionomer that has about 90% of its acid groups neutralizied with magnesium hydroxide is present in an amount of about 5% by weight of the mixture.

21. A process for preparing a nonwoven web comprising extruding fibers from a molten polymeric resin consisting essentially of one or more ionomers or one or more ionomers mixed with a compatible copolymer or terpolymer, and forming a nonwoven web from the fibers.

22. The process of claim 21 wherein said step of extruding fibers comprises meltblowing the fibers.

23. The process of claim 21 wherein the fibers are continuous filaments and said step of forming a nonwoven web from the fibers comprises depositing the filaments on a collection surface to form a web and bonding the web by applying heat or pressure or both to the fibers.

24. The process of claim 21 wherein said ionomers are salts of copolymers or terpolymers containing groups derived from ethylenically unsaturated sulfonic acids and carboxylic acids or anhydride precursors thereof and wherein the acid groups of the copolymer or terpolymer comprise at least about 1% by weight of said copolymer or terpolymer.

25. The process of claim 24 wherein the acid groups of the copolymer or terpolymer comprise at least about 8% to 40% by weight of said copolymer or terpolymer.

26. The process of claim 24 wherein at least about 25% of the acid groups are neutralized to form salts of univalent or multivalent cations.

27. The process of claim 24 wherein at least about 50% of said acid groups are neutralized.

28. The process claim 24 wherein at least about 90% of the acid groups are neutralized.

29. The process of claim 24 wherein said one or more ionomer salts are salts of copolymers of from at least about 60 to 99% by weight ethylene and from at least about 1 to 40% by weight acrylic acid.

30. The process of claim 24 wherein said one or more ionomer salts are 90% neutralized salts of copolymers selected from among the group comprising copolymers of about 77% ethylene and 23% acrylic acid by weight and copolymers of about 67% ethylene and 33% acrylic acid by weight.

31. The process of claim 21 wherein cross linking is introduced in said ionomer by the addition of multivalent metal ions.

32. The process of claim 31 wherein said multivalent metal ions are selected from among the group consisting of $Ca^{+2}$, $Mg^{+2}$, $Ba^{+2}$, $Al^{+3}$, and $Ti^{+4}$.

33. The process of claim 21 wherein said one or more ionomers are selected from among the group consisting of copolymers and terpolymers containing cations of sodium, potassium, lithium, calcium, magnesium, barium, aluminum, and titanium, and cations derived from ammonia or amines, and blends of said ionomers.

* * * * *